US005101142A

United States Patent [19]

Chatfield

[11] Patent Number: 5,101,142

[45] Date of Patent: Mar. 31, 1992

[54] SOLID-STATE BALLAST FOR FLUORESCENT LAMP WITH MULTIPLE DIMMING

[75] Inventor: Richard C. Chatfield, Lutz, Fla.

[73] Assignee: Applied Lumens, Ltd., Lake Forest, Ill.

[21] Appl. No.: 577,670

[22] Filed: Sep. 5, 1990

[51] Int. Cl.[5] ..... H05B 37/02

[52] U.S. Cl. ..... 315/308; 315/117; 315/118; 315/309; 315/DIG. 4

[58] Field of Search ..... 315/308, DIG. 4, 117, 315/118, 309, 224

[56] References Cited

U.S. PATENT DOCUMENTS 4,414,493 11/1983 Henrich ..... 315/308
4,441,054 4/1984 Bay ..... 315/219
4,463,284 7/1984 Tamura et al. ..... 315/158
4,523,131 6/1985 Zansky ..... 315/DIG. 4
4,682,080 7/1987 Ogawa et al. ..... 315/209 R
4,904,906 2/1990 Atherton et al. ..... 315/291

*Primary Examiner*—Eugene R. LaRoche
*Assistant Examiner*—Son Dinh
*Attorney, Agent, or Firm*—Charles A. McClure

[57] ABSTRACT

Dimming fluorescent lamp solid-state ballast. The ballast is adapted for automatic sensing and control of lamp temperature to dim the lamp to an optimal operating temperature, such as that at which the light output is a maximum per energy input. The ballast is also adapted for manual continuously adjustable or multi-position stepwise dimming control, which may include such an optimal setting. Other available dimming settings include undimmed or maximum light output, and/or the lamp's minimal sustainable light output.

16 Claims, 3 Drawing Sheets

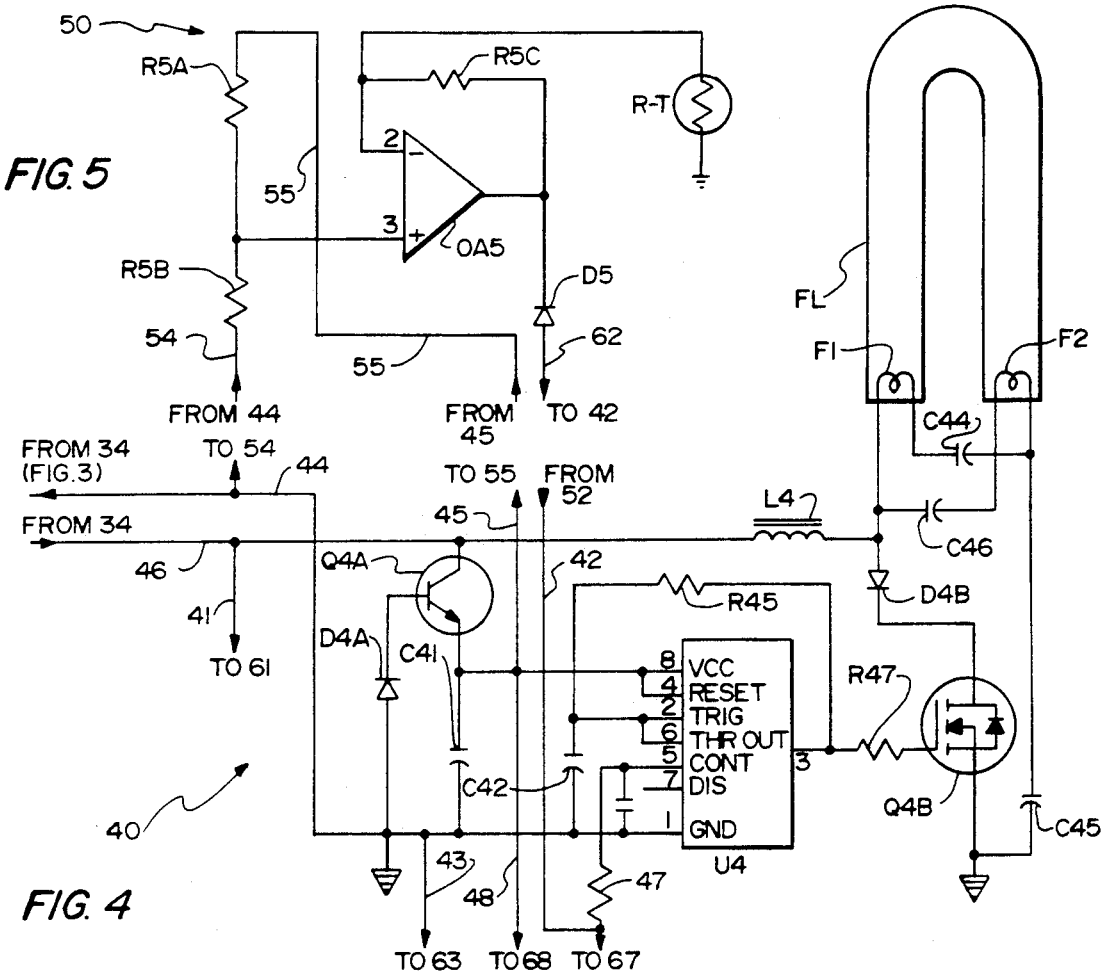
FIG. 5
FIG. 4
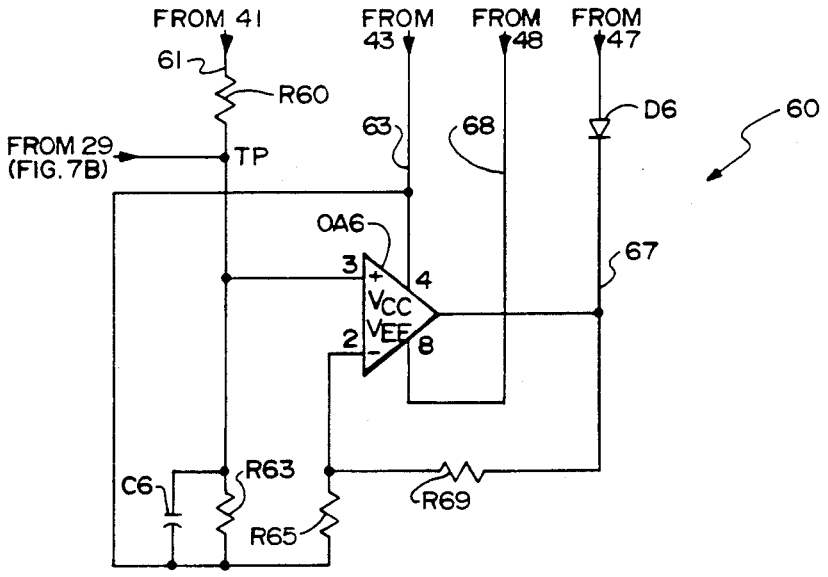
FIG. 6

SOLID-STATE BALLAST FOR FLUORESCENT LAMP WITH MULTIPLE DIMMING

TECHNICAL FIELD

This invention relates to solid-state ballasts for fluorescent lamps, especially ballasts adapted for controlling light output.

BACKGROUND OF THE INVENTION

As is well known, fluorescent lamps have a number of advantages over incandescent lamps, including lower power consumption per light output, lower heat output (and, thus, lower air-cooling load), and longer useful life— and, therefore, lower replacement labor cost. Fluorescent lamps are now being provided with screw-in Edison bases for use as replacements for incandescent lamps. A fluorescent lamp system requires— in addition to a lamp bulb itself— a "ballast" to ensure proper starting and operating conditions.

Iron-core inductive ballasts, though customary for fluorescent lamps for many years, are being superseded by solid-state ballasts. Representative disclosures of solid-state ballasts in U.S. Pat. Nos. include Stoltz Pat. 4,251,752; Stevens Pat. 4,277,728; Knoll Pat. 4,109,307; and Perper Pat. 4,017,785; plus references cited therein.

Solid-state ballasts not only enable flicker-free, hum-free fluorescent lighting but also are more compact, lighter in weight, and adapted to controlling lamp operation in ways not possible with iron cores. Included among conditions desirably controlled via the ballast are voltage, current, frequency, and light output.

Even solid-state ballasts may have such faults as operating a lamp at hotter than optimal temperature, or providing harmonic-laden inputs of limited contribution to light output, and/or lacking the capability of being dimmable as incandescent lamps are— over a broad range and whenever maximum light output is unnecessary or unwanted.

Dimming with solid-state ballasts is disclosed in such U.S. Pat. Nos. as Capewell et al. 4,207,497; Spira et al. Pats. 4,207,798 & 4,350,935; Zansky Pat. 4,370,600; Hyltin Pat. 4,388,563; Burke Pat. 4,686,427; and Summa 4,859,914 — by such methods as varying the amplitude and/or the duty cycle of the input to or the output from the ballast. However, a need exists for a more versatile ballast, preferably with multiple dimming modes.

SUMMARY OF THE INVENTION

A primary object of the present invention is a fluorescent lamp ballast providing improved lamp output light control.

Another object of this invention is to provide such control and substantially harmonic-free electrical input at unity power factor.

A further object of the invention is to optimize fluorescent lamp output light per watt input if maximum output is not needed.

Yet another object is to render fluorescent lamps dimmable substantially below such economically optimal output.

A still further object is to accomplish the foregoing objects by means of a compact replaceable or throw-away ballast.

In general, the objects of the present invention are attained in a fluorescent lamp ballast assembly adapted to control duty cycle and output frequency of the ballast as input to a fluorescent lamp, and enabling control of lamp operating temperature and light output manually and/or automatically. More particularly, the objects are accomplished by providing an improved fluorescent lamp ballast with thermistor means to sense lamp temperature and to control, via responsive component circuit means, the temperature of the lamp by dimming it. Such lamp ballast is also operable in combination with continuously adjustable and/or multiple-switching dimming means, Other objects of the present invention, together with means and methods for attaining the various objects, will be apparent from the following description and the accompanying diagrams of a preferred embodiment presented by way of example rather than limitation.

SUMMARY OF THE DRAWINGS

FIG. 4 is a similar diagram of the BALLAST AND LAMP block; and

FIG. 5 is a similar diagram of the INTERNAL DIMMING block;

FIG. 6 is a similar diagram of the EXTERNAL DIMMING block;

DESCRIPTION OF THE INVENTION

Figure 1:
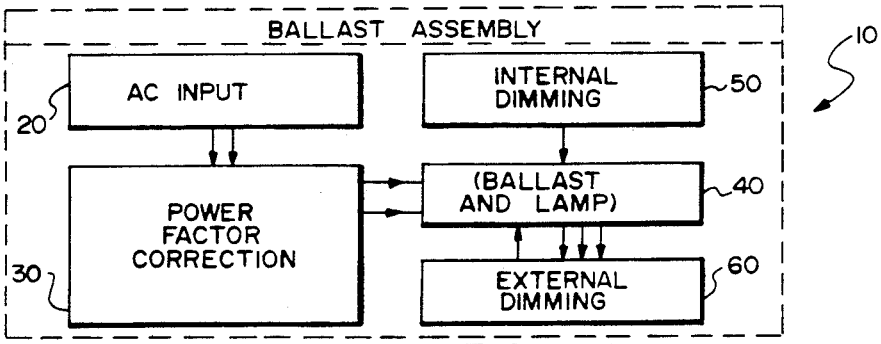
FIG. 1 is a schematic diagram of apparatus of this invention, designating— as component blocks — A.C. INPUT, POWER FACTOR CORRECTION, BALLAST AND LAMP, INTERNAL DIMMING, AND EXTERNAL DIMMING.

FIG. 1 is a block diagram of apparatus of this invention designated BALLAST ASSEMBLY (WITH LAMP) 10 as apportioned among five component blocks— shown with arrows to suggest their interconnections. Their respective blocks are shown in more detail in subsequent views. It is apparent in FIG. 1 that an A.C. INPUT component 20 (upper left corner, detailed in FIG. 2) feeds a POWER FACTOR CORRECTION component 30 (detailed in FIG. 3), which does likewise to a BALLAST (AND LAMP) component 40 (detailed in FIG. 4). INTERNAL DIMMING component 50 (detailed in FIG. 5), and EXTERNAL DIMMING component 60 (detailed in FIG. 6) feed back to, and influence the operation of, the BALLAST (AND LAMP) component. In the more detailed diagrams, circuit elements and selected leads are designated by reference numerals and/or letters, with initial numerals usually keyed to the respective Fig. numbers to facilitate reference.

Figure 2:
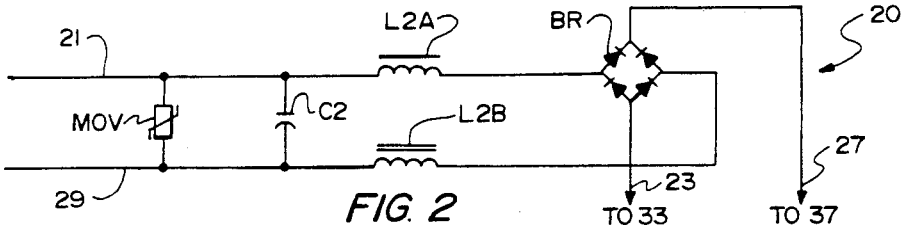
FIG. 2 is a schematic circuit diagram of the A.C. INPUT block.

FIG. 2 shows A.C. INPUT component 20. Single-phase input power line leads 21 and 29 are bridged by transient-surge-suppressing metal oxide varistor MOV, which conducts little at line voltage but conducts disproportionately readily at higher voltages to shield the apparatus from ill effects of lightning and switching transients by shunting them to ground. The input leads also contain an E.M.I. filter (against conducting emissions back into the power line), which has low impedance at line frequency but very high impedance at R.F. frequencies. The filter comprises capacitor C2 bridging the power line leads, and inductors L2A and L2B in the respective line lead. The leads go to opposite sides of full-wave rectifying bridge BR. Output leads 23 (−) and 27 (+) from the bridge conduct the rectified output to the POWER FACTOR CORRECTION component, shown next.

Figure 3:
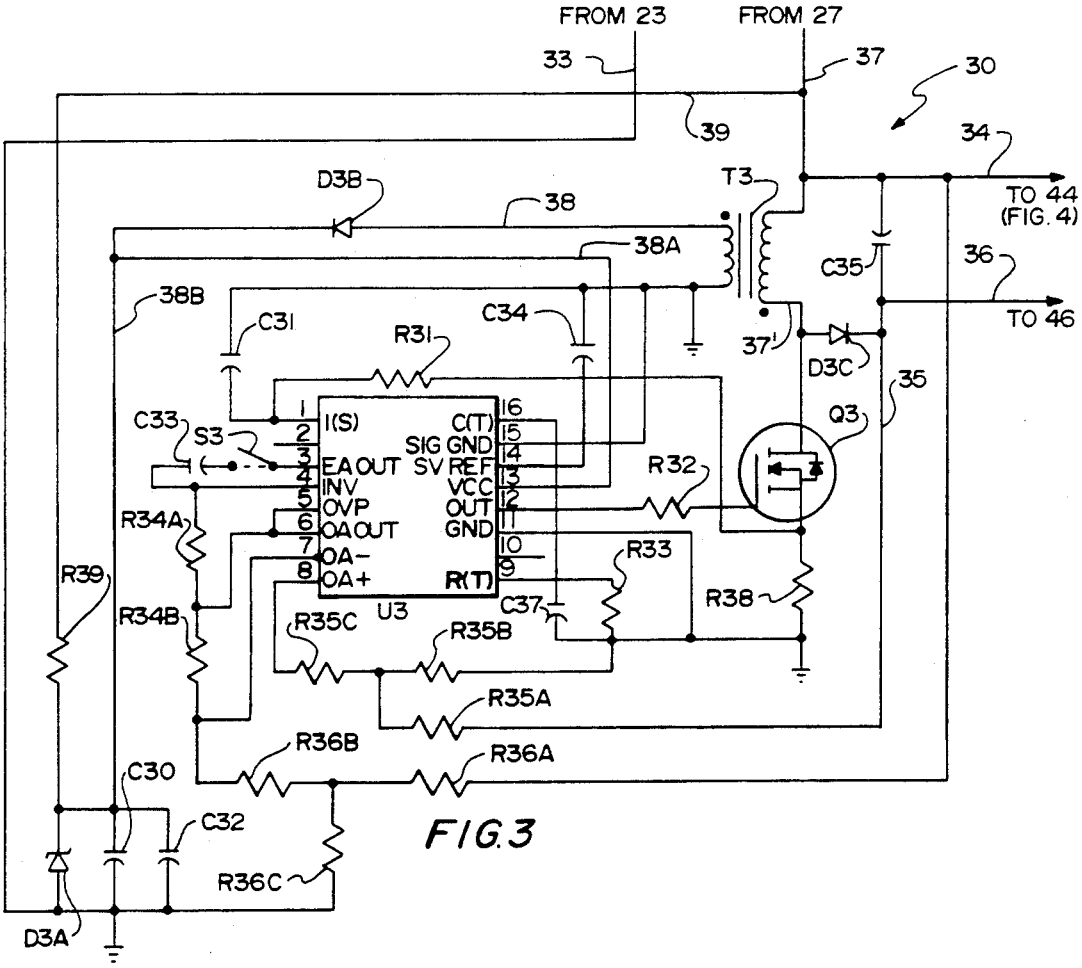
FIG. 3 is a like diagram of the POWER FACTOR CORRECTION block.

FIG. 3 shows POWER FACTOR CORRECTION component 30, with input transformer T3, integrated circuit (I.C.) U3 (such as an ML4813), and MOSFET Q3 (such as an MPT2N50) as its main features. Lead 23 from bridge BR in FIG. 1 becomes (negative) lead 33 here and goes directly to ground. Lead 27 from the bridge becomes (positive) lead 37 here and branches (at the left) to lead 39 containing resistor R39 in series with zener diode D3A to ground, and (to the right) to leads 35 and 36 within this component, as well as output lead 34 to the next component. Lead 37 connects to the top of the T3 primary winding, then as lead 37' from the bottom of the winding to the drain of Q3, whose source lead goes to ground through resistor R38 and whose gate connects to output pin 12 of U3 through resistor R32. The bottom end of the T3 secondary winding is grounded, as is signal ground pin 15 of U3. Top lead 38 of the T3 secondary is connected through diode D3B by first branch lead 38A to U3 positive supply (Vcc) pin 13 and by second branch lead 38B to parallel capacitors C30 and C32 connected to ground in parallel with diode D3A (in lead 39). Diode D3C from the Q3 drain electrode connects lead 37' to lead 35, effectively paralleling the T3 primary winding with capacitor C35, which bridges output leads 34 and 35 to respective leads 44 and 46 in the next component (FIG. 4).

Lead 35 in FIG. 3 goes through resistor R35A to a mutual junction with resistors R35B (connected to ground) and R35C connected directly to non-inverting (+) input pin 8 of a U3 uncommitted operational amplifier. Lead 36 connects in like manner through resistor R36A to the junction with resistors R36C (connected to ground) and R36B connected directly to inverting (−) input pin 7 of the U3 opamp and through resistor R34B to input voltage pin 5 to an overvoltage comparator in U3, and to opamp output pin 6, and then through resistor R34A directly to input voltage pin 4 for control loop feedback voltage, bridged to U3 error amplifier output voltage pin 3 by capacitor C33. Reference voltage (5 v.) pin 14 and oscillator timing pins 16 and 9 have respective circuit elements C34, C37, and R33 between them and ground.

The just described POWER FACTOR CORRECTION circuit of FIG. 3 is a buck & boost switching which forces the average current drawn from to be directly proportional to the output voltage from the bridge. It operates in a discontinuous conduction mode, in which there are distinct charging, discharging, and idle states. Operation of this apparatus is readily understood as summarized below.

When power is first applied, bleed current to ground through resistor R39 charges parallel capacitors C30 and C32 charge to about 16 v. whereupon U3 begins to operate. Capacitor C37 charges till it reaches about 4.3 v., whereupon U3 discharges it to ground through timing pin 16 and enables the switch drive output at pin 12. When C37 drops to about one volt it starts recharging, and pin 12 goes high for the first time, gating Q3 to conduct. The flow of current through Q3 (and the primary winding of T3) produces a rising potential at the end of sensing resistor R38 tied to the source electrode of Q3 and through resistor R31 to U3 current-sensing pin 1, and when that potential reaches one volt the output pin (12) goes low. Then conduction through Q3 ceases, effectively isolating the apparatus of FIG. 3 temporarily from that of FIG. 2.

An idle period ensues so far as the A.C. INPUT component is concerned until the charging condition recurs. The charging ramp of the first cycle having ended, discharging begins, whereupon the energy stored in the T3 primary winding is transferred to capacitor C35 (where it is stored as accumulated charge) through diode D3C. Such flow ramps down as C35 charges much as the current ramped up during Q3 conduction, in a triangular pattern vs. time. A notable result is that average current and voltage peaks, valleys, and interconnections occur together, reflecting to the input power lines as pure resistance— unity power factor.

Operating potential for subsequent cycles is supplied by the secondary winding of transformer T3 via diode D3B to pin 13 of U3. Diode D3A precludes the starting and operating potentials together from exceeding the operating voltage for U3 (Vcc =15 volts). Resistors R35A,B,C with R36A,B,C and R34B form a differential amplifier by connections to OA pins 8, 7, and 6 of U3; and the OA output at pin 6 is routed to output overvoltage protective pin 5 and error amplifier pin 4, with resistor R34A and capacitor C33 providing loop damping for the internal error amplifier, which functions to compensate for variations in the input voltage, that is to "regulate" it (which may be omitted when not desired, as by opening switch S3 in the pin 3 lead). Capacitor C31 at pin 1 filters switching transients to prevent malfunction of the current limit function, and C34 filters the reference voltage at pin 14.

Additional information about the structure and operation of U3 can be obtained from Micro Linear, in ML4813 specification sheets, including suitable values for circuit elements in such use.

FIG. 4 shows BALLAST (AND LAMP) component 40, featuring I.C. U4 (such as a 555), transistor Q4A (such as an MJE13003) and MOSFET Q4B (such as an MPT2N50— like Q3 of FIG. 3) as well as fluorescent lamp FL, which may be any of many commercial lamps but preferably is that shown in FIG. 8 and described below. The lamp has two filaments F1 and F2. Outside the lamp, pin contacts 1 and 3 are joined by capacitor C46, and pin contacts 2 and 4 are joined by capacitor C44, whereas inside the lamp, pin contacts 1 and 2 are connected by filament F1, and pin contacts 3 and 4 are connected by filament F2.

FIG. 4 input leads 44 and 46 enter from the left, corresponding to leads 34 and 36 of the FIG. 3 POWER FACTOR CORRECTION component. Input lead 46 goes to the collector of Q4A and on to one end of inductor L4, whose other end lead is connected to lamp FL at filament pin 1, while lead 46 goes to GND ANALOG and to GND pin 1 of I.C. U4. Lead 44, though connected to positive input voltage— the negative side of capacitor C35 in FIG. 3— becomes an analog ground in the components of FIGS. 4, 5, and 6. Inasmuch as such ground rides above the (earth) ground of previous components, attempts to connect them (whether by test equipment or otherwise) is extremely undesirable.

Transistor Q4A has zener diode D4A in its base lead, and has capacitor C41 in its emitter lead to GND ANALOG. Its emitter is tied directly to Vcc pin 8 and to reset pin 4 of U4 (and leads 45 and 48 go from there to lead 55 in FIG. 5 and lead 68 in FIG. 6). Control pin 5 of U4 connects through resistor R47 to the junction of lead 45 (from lead 55 in FIG. 5) and lead 47 (from lead 67 in FIG. 6) for control purposes considered further below in description of the components illustrated in those respective views. Capacitor C47 is between control 5 pin and ground pin 1. Threshold pin 6 and trigger pin 2 are tied to series junction of capacitor C42 (from GND ANALOG) and resistor R45 to output pin 3 and on via resistor R47 to the gate electrode of Q4B. The source of Q4B is tied directly to GND ANALOG, and capacitor C44 connects from there directly to pin contact 4 of lamp filament F2, and via capacitor C44 to pin contact 2 of filament F1. The Q4B drain is connected through diode D4B to the right side of inductor L4 and to pin 1 of filament F1 of the lamp and via capacitor C46 to pin 3 of filament F2 of the lamp.

This component also has several operating conditions, including a pre-ignition condition of the lamp, a continuous operating condition, and variants on otherwise customary operating conditions. At the outset the lamp filaments are cold and must be heated substantially to start the lamp— aided by the presence of an emissive coating on the filaments. Transistor Q4A in conjunction with diode D4A regulates operating potential to I.C. U4, which outputs a high frequency square wave to Q4B, which in turn operates here much like Q3 in the preceding component but into a resonant circuit of inductance L3 (in place of the T1 primary) and capacitor C45 (instead of C35).

Capacitors C44 and C46 in FIG. 4 are much smaller than C45, so they are the primary determinant of the resonant frequency during startup. Hence, the output from U3B at start-up is at a much higher frequency than the normal operating resonant frequency and passes preferentially through the small capacitors and the lamp filaments, heating the filaments. Soon the lamp filaments heat up, and the voltage on C44 and C46 builds to a level at which lamp FL lights and current flows preferentially through the lamp rather than its filaments. Then capacitors C44 and C46 are unimportant— except for dimming purposes (considered later).

Factors affecting operation of the ballast in FIG. 4 actually or potentially include not only the D.C. potential across the output capacitor (C35) of the previous component (FIG. 3) but other characteristics, whether endogenous (e.g., frequency) or exogenous (e.g., conduction angle) or mixed (e.g., voltage, temperature). In what may be termed uncontrolled operation of the ballast, output from U4 is a 50% duty cycle high-frequency square wave drive to the gate of Q4B at a relatively stable frequency selected to be slightly below the resonant frequency of L4 and C45. As long as the voltage at CONTROL pin 5 of U4 is about ten volts, such operation results. This can be considered as the level of minimum operating frequency, maximum ballast output, lamp power, and lamp light output.

FIG. 5 shows INTERNAL DIMMING component 50 featuring operational amplifier OA5 and thermistor RT— which is located in the vicinity of lamp FL so as to be responsive to lamp temperature. The inverting (+) input at pin 2 of opamp OA5 is connected to D.C. voltage received via lead 55 (from lead 45 in FIG. 4) at the junction of resistors R5A and R5B connected as a voltage divider. The thermistor connects directly to opamp OA5 non-inverting (−) input pin 2, which connects via resistor R5C to the opamp output pin and through diode D5 in lead 52 to control lead 42 of FIG. 4.

As lamp FL increases in temperature after lighting, juxtaposed thermistor RT increases in resistance and reduces OA5 gain— which is proportionate to the fraction R1/RT and the fraction R5B/(R5A +R5B) and to the voltage across R5A +R5B. The output voltage of OA5 applied at CONTROL pin 5 of U4 falls accordingly, as does the output of U4 gated to Q4B. The Q4B period decreases, and so does the net input to the lamp and, thus, its energy consumed and its light output— but at increased frequency, which keeps it lighted.

Values of the control factors mentioned are selected to reduce operation of the lamp to as close as desired to an optimal operating condition, in the sense of maximum light output per unit of energy input. Such a condition may and usually will vary from one type of lamp to another and with changes in the environment of the lamp. In the instance of the previously noted preferred lamp in a canister-like housing, about 85% of its rated power to the lamp is optimum. Such 15% reduction in input energy to the lamp corresponds to about half as much increase in lamp operating frequency.

FIG. 6 shows EXTERNAL DIMMING component 60, featuring operational amplifier OA6. Lead 63 from analog ground (FIG. 4) lead 43 provides Vee to pin 8 of the opamp, whereas lead 68 from Q4A lead 48 provides Vcc to pin 4 and connects via resistor R65 in series with the parallel combination of capacitor C6 and resistor R63 to non-inverting (−) input pin 2, which has resistor R69 connected between it and the opamp output lead 55. Lead 61 via positive lead 41 from lead 46 (both in FIG. 4) connects through resistor 60 to OA6 inverting (+) input pin 3. The opamp output lead connects through diode D6 to the control pin (5) of I.C. U4 in the BALLAST (AND LAMP) component (FIG. 4). This EXTERNAL DIMMING component may be responsive to continuous adjustment, as by the variable conduction angle arrangement shown in FIG. 7A, or by stepwise adjustment such as the common three-way manual switching arrangement shown in FIG. 7B.

Figure 7A:
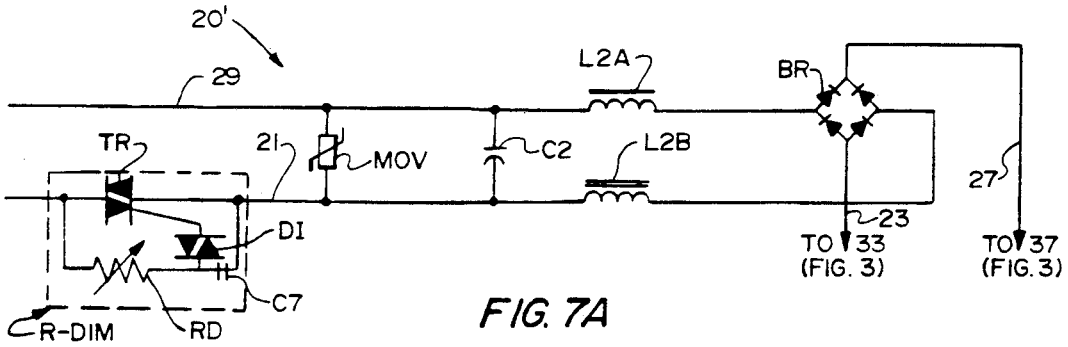
FIG. 7A is a schematic circuit diagram of another embodiment of A.C. INPUT component, with continuously adjustable dimming means.

FIG. 7A shows first alternative A.C. INPUT component 20', which features otherwise conventional input line conduction angle control R-DIM in addition to the MOV, filter capacitor and inductors, and bridge of FIG. 2. Such control is interposed in power input lead 2 ahead of the FIG. 2 components and may be located in the circuit on a nearby wall in the general vicinity of the lamp rather than at the lamp itself. Control R-DIM features triac TR in line 21 paralleled by a branch containing variable resistor RD in series with capacitor C7. Diac DI connects from the resistor-capacitor junction to the triac gate. When this dimming arrangement is used, switch S3 in the POWER FACTOR CORRECTION component is opened to inactivate the error correction circuit, which would attempt to cancel out phase dimming. Adjustment of RD to increased value decreases conduction duration to reduce the RMS voltage input to the next component, which results in lowering the duty cycle of lamp driver Q4B and less light output.

Figure 7B:
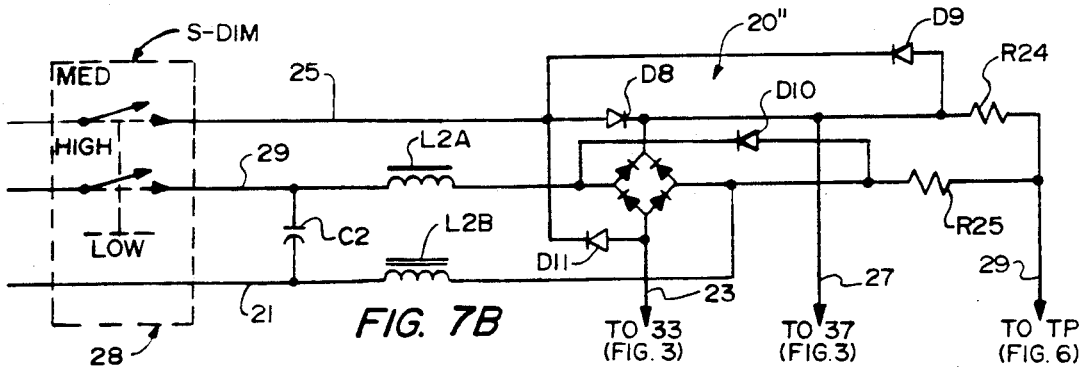
FIG. 7B is a similar diagram of yet another A.C. INPUT component, with multiple (3-way) stepwise dimming means.

FIG. 7B shows second alternative A.C. INPUT component 20", with multiple (3-way) switch S-DIM ahead of the MOV, filter, and bridge and with third lead 25— to an intermediate electrode between the center contact and the shell on the lamp base, as on 3-way incandescent lamp bases— supplementing FIG. 2 leads 21 (center) and 29 (shell). S-DIM has three arms, one in each lead, so connected that at the LOW setting all three switch arms are in circuit in their respective lines, whereas at the other settings a single switch arm is open. At the intermediate or MED setting the switch arm in added line 25 is open, and at the HIGH setting the arm in neutral line 29 is open. Also in FIG. 7B, diode D8 is present in added intermediate lead 25 before connection to the top (+) of bridge BR, and resistor R24 is in lead 29 from the top of the bridge, both being paralleled by oppositely directed diode D9. Resistor R25 is added between the right corner of the bridge and new output lead 29, and oppositely directed diode D10 connects to the opposite corner of the bridge.

Additional output line 29 from this FIG. 7B component connects to tiepoint TP in EXTERNAL DIMMING component 60 of FIG. 6. Diode D11 connects the bottom (−) of the bridge to added input lead 25 ahead of diode D8. With this arrangement the output of OA6 (FIG. 6) as a non-inverting buffer is proportional to the root-mean-square (RMS) voltage output of the POWER FACTOR CORRECTION component times R63/(R61+R63) less such RMS voltage, times the RMS input voltage from the power line times composite resistance RS, where RS is different in the LOW, MED, and HIGH settings of the 3-way switch. (See below.) In the LOW position of multiple switch S-DIM, RS is at its lowest value, being the parallel combination of R24 and R25. In the MED position, RS is at an intermediate value (equal to R24) because R25 is no longer in the circuit, and in the HIGH position, RS is at its highest value (equal to R25) for a like reason. The middle position can be set for the optimal light output per watt input (or other preselected condition), and the low setting to operate the lamp dimmed near its drop-out point. As already suggested, such a three-position switching arrangement can be wired in accordance with the three-point switching of an incandescent lamp.

Steering diodes D5 in FIG. 5 and D6 in FIG. 6 ensure that the ultimate control of lamp operation lies with whichever dimming component, whether internal (as in FIG. 5) or external (as in FIG. 6), that provides the lesser voltage to the control pin of U4 in FIG. 4.

Figure 8:
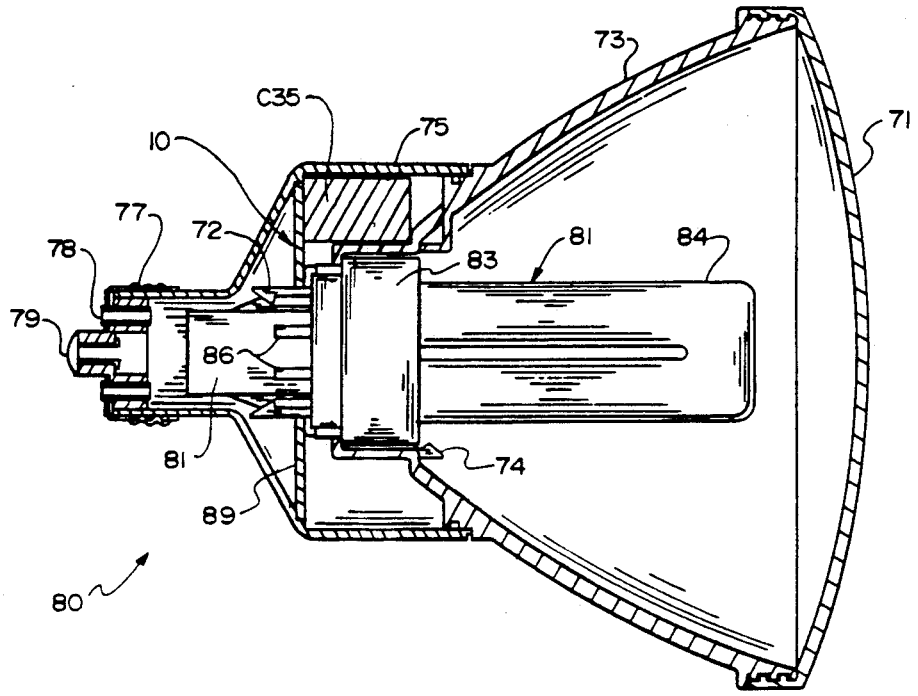
FIG. 8 is a side sectional elevation of a preferred fluorescent lamp with a ballast according to this invention.

FIG. 8 shows, in side sectional elevation, a fluorescent lamp assembly 80 including a ballast according to the present invention. The illustrated lamp assembly is disclosed in concurrently filed and commonly owned G.R. Peshak patent application Ser. No. 07/577,492.

Removable lens 71 covers the right end of reflector housing 73 and has flutes 72 (concave indentations) spaced at regular intervals about its flanged circumferential edge to aid anyone in unscrewing it. Generally frustoconical reflector housing 73 has shoulder 85 between the smaller end part of its conical major portion and an even smaller cylindrical portion 77 at its left end. Edison hood 75 has right cylindrical portion 72, which overlies the reflector housing's small end and abuts its shoulder, leaving space between the housing and the hood occupied by ballast assembly 10 of this invention. Edison hood 75 necks down (at left) to smaller cylindrical portion 84 with screw-in Edison electrical base 77 from which central terminal 79 protrudes.

Circuit board 89 of ballast assembly 10 is conveniently retained within the annular space between the two housing members, Edison hood 75 and reflector housing 73. The circuit board has a central opening to accommodate extension 89 of the fluorescent bulb base therewithin. The components on the circuit board include most prominently capacitor 35, but no attempt is made here to depict other electrical components on the board as they are quite small.

It will be understood that leads connect to the screw-in base and the central terminal— and to intermediate electrode 78— of the lamp in conventional manner. Not shown in any view is ballast potting material, which may (but need not) be present.

The preferred lamp enables ready interchangeability and/or replacement of such ballast— along with or as well as lenses and lamp bulbs. The circuit board of the ballast of this invention has contactor openings adapted to be engaged by pin contacts protruding from the base of the lamp, so a lamp may be disengaged from the ballast board simply by pulling it out. Ballasts may be changed by detaching the Edison hood from the reflector housing, pulling the ballast assembly circuit board off the base of the installed lamp bulb, and disconnecting its electrical leads, inserting a new ballast assembly circuit board, connecting its leads in place of the ones just disconnected, and screwing the Edison hood back onto the reflector housing. Alternatively, the Edison hood with the ballast assembly still attached may be discarded entirely, and a new Edison hood with new ballast assembly installed be screwed onto the reflector housing in place of the one removed. Thus, the reflector housing houses mainly the lamp bulb assembly, whereas the Edison hood houses mainly the ballast assembly, although those two housings together constitute a composite housing for both ballast and bulb.

The advantages and benefits of operating a fluorescent lamp at its most economical operating temperature level, such as about 50° C. for the preferred lamp of this invention, include not only saving energy but also extending the lamp life, both of which also save operating and maintenance costs. As noted, such operation can be assured automatically by thermistor sensing of lamp operating temperature and consequent control of that temperature by the ballast. Or the intermediate (or even the high) setting of a multiple-switch dimming ballast embodiment can be preset for such optimal operation. A low setting may operate the lamp at its least energy input for its minimum sustainable light output. This ballast, with the variety of controls described, can dim the preferred lamp to from twenty-five percent to as low as five percent of maximum output. The advantages of its continuously and/or stepwise dimming ballast operation will accrue and become apparent to those who practice the invention.

Preferred embodiments and variants have been suggested for this invention. Other modifications may be made, as by adding, combining, deleting, or subdividing compositions, parts, or steps, while retaining all or some of the advantages and benefits of the present invention— which itself is defined in the following claims.

The claimed invention is:

1. Solid-state fluorescent-lamp ballast apparatus, comprising sensor means adapted to sense the operating temperature of a fluorescent lamp receiving input from the ballast apparatus, and control means responsive to the sensed lamp temperature and adapted to adjust input to the lamp so as to attain and maintain an optimal lamp-operating temperature effective to maximize light output per watt of electrical power input to the ballast apparatus.

2. Lamp ballast apparatus according to claim 1, wherein the lamp-operating temperature in the absence of such control means would exceed such optimal temperature, and the control means reduces the duration and increases the frequency of input to the lamp relative to the power and frequency absent such control means.

3. Lamp ballast apparatus according to claim 1, wherein such optimal lamp-operating temperature is preselected.

4. Lamp ballast apparatus according to claim 1, wherein the preselected lamp-operating temperature is on the order of 50° C.

5. Solid-state fluorescent-lamp according to claim 1 combined with multiple-position switch means with these effective settings;

(a) high-output setting, at which the light output and lamp-operating temperature are higher than at maximum light output per watt of electrical power input to the ballast apparatus;

(b) intermediate-output setting, maximizing light output per watt of electrical power input to the ballast apparatus; and (c) low-output (dimmed) setting, at which the light output and lamp-operating temperature are lower than at maximum light output per watt of electrical power input to the ballast apparatus.

6. Lamp ballast apparatus according to claim 1, wherein the multiple-position switch is continuously adjustable and effective to provide a range of light outputs from (a) higher than optimal; through (b) optimal, in the sense of maximum light output per watt of input to the apparatus; and to (c) dimmed, in the sense of being below such optimal output.

7. Method of operating a fluorescent lamp with a solid-state ballast, including the step of sensing the lamp-operating temperature and controlling the operating temperature to a preselected optimum providing maximum light output per watt of electrical energy input to the fluorescent lamp with ballast.

8. Method of energizing a fluorescent lamp for optimal sustained light output per watt of input electrical energy, comprising providing to the lamp an A.C. electrical input voltage at an energy input and frequency effective to operate the lamp, sensing the operating temperature of the lamp, and reducing the operating temperature to a value at which the light output from the lamp is greatest per watt of input energy.

9. Method of energizing a fluorescent lamp according to claim 8, including manually setting a control of the lamp input energy effective to control light output.

10. Method of energizing a fluorescent lamp according to claim 9 including setting such control for maximum sustained light output.

11. Method of energizing a fluorescent lamp according to claim 9, including setting such control for optimal light output from the lamp per watt of input energy.

12. Method of energizing a fluorescent lamp according to claim 9, including setting such control for minimum sustained light output.

13. Method of operating a fluorescent lamp with solid-state ballast for optimal sustained light output per watt of input electrical energy, comprising providing to the lamp A.C. electrical input voltage at an energy input and frequency effective to operate the lamp, sensing the operating temperature of the lamp, and controlling the operating temperature to a value at which the light output from the lamp is greater per watt of input energy.

14. Method of operating a fluorescent lamp according to claim 1, wherein the lamp-operating temperature in the absence of such control means would exceed such preselected temperature, including reducing the duration and increasing the frequency of input to the lamp relative to the duration and frequency absent such controlling.

15. Method of operating a fluorescent lamp according to claim 13, including preselecting the optimal lamp-operating temperature.

16. Method of operating a fluorescent lamp according to claim 15, wherein the preselected lamp-operating temperature is on the order of 50° C.

* * * * *